US007045792B2

(12) United States Patent
Parr et al.

(10) Patent No.: US 7,045,792 B2
(45) Date of Patent: May 16, 2006

(54) CHARGED PARTICLE BUNCHER

(75) Inventors: Victor Carl Parr, Bowlee (GB); Stephen Paul Thompson, Manchester (GB); Mark Duncan Mills, Brooklands (GB)

(73) Assignee: Scientific Analysis Instruments, Ltd., Manchester (GB)

( * ) Notice: Subject to any disclaimer, the term of this patent is extended or adjusted under 35 U.S.C. 154(b) by 0 days.

(21) Appl. No.: 10/641,189

(22) Filed: Aug. 14, 2003

(65) Prior Publication Data

US 2004/0065842 A1 Apr. 8, 2004

(30) Foreign Application Priority Data

Aug. 16, 2002 (GB) ..... 0219072.6

(51) Int. Cl.
*H01J 3/14* (2006.01)

(52) U.S. Cl. ..... 250/396 R; 250/492.3; 313/363.1; 315/111.61

(58) Field of Classification Search ..... 250/396 R
See application file for complete search history.

(56) References Cited

U.S. PATENT DOCUMENTS

| | | | | |
|---|---|---|---|---|
| 2003/0001088 | A1* | 1/2003 | Bateman et al. | 250/287 |
| 2004/0026613 | A1* | 2/2004 | Bateman et al. | 250/281 |

FOREIGN PATENT DOCUMENTS

| | | |
|---|---|---|
| EP | 0 456 516 A2 | 11/1991 |
| EP | 1 271 608 A2 | 1/2003 |
| GB | 0737715 | 9/1955 |
| GB | 1064797 | 4/1967 |
| WO | WO 00/36633 | 6/2000 |
| WO | WO 02/103747 | 12/2002 |

* cited by examiner

*Primary Examiner*—Nikita Wells
*Assistant Examiner*—James J. Leybourne
(74) *Attorney, Agent, or Firm*—Barlow, Josephs & Holmes, Ltd.

(57) ABSTRACT

A charged particle buncher with a series of spaced apart electrodes 1 arranged to generate a shaped electric field, the series comprising a first electrode 1*a*, a last electrode 1*b* and one or more intermediate electrodes, wherein the shaped electric field is generated substantially without free charges being transferred onto or away from the intermediate electrode or electrodes. The first and last electrodes may be connected to means for transferring charged on to or off the electrode. The first, intermediate and last electrodes may be connected in serried with capacitors.

9 Claims, 3 Drawing Sheets

CHARGED PARTICLE BUNCHER

BACKGROUND OF THE INVENTION

The present invention relates to a charged particle buncher.

Charged particle bunchers operate to collect charged particles which are spatially dispersed along one or more axes and bring them closer together later in time. A primary application of charged particle bunchers is in time of flight mass spectrometry.

A simple form of charged particle buncher comprises two spaced apart plate electrodes. The electrodes are spaced apart and generally parallel to each other. Each electrode includes an aperture near its center through which charged particles may pass. In use, a group of charged particles drift along an axis extending between the electrodes through the aperture in each electrode. Each electrode is initially held at a first potential. The value of the potential of one of the electrodes is then rapidly adjusted by means of a high-speed switch. For example, initially both electrodes might be held at ground and then the potential of one of the electrodes is rapidly increased to a value V. This generates an electric field between the plates that can accelerate or decelerate charged particles moving between the plates causing them to bunch. In practice, the potential must be changed in a time that is much shorter than the time taken for the charged particles to travel between the electrodes.

Where two flat plate electrodes are used, the electric field is uniform between the plates. Such a field will provide first order bunching of a group of charged particles drifting between the two electrodes of the device.

Higher order bunching can be achieved by generating a non-uniform, or shaped, electric field. EP 0456516 discloses a charged particle buncher for storing ions moving along a path. The buncher is arranged to subject ions to a retarding field during an initial part only of a preset time interval. The field has a spatial variation such that ions that have the same mass-to-charge ratio and enter the buncher during the initial part of the pre-set time interval are all brought to a time focus during the remaining part of the time interval. The retarding field is generated by a plurality of spaced apart hyperboloid electrodes that lie along equipotentials of the retarding field. The electrodes are maintained at the required voltages through being connected together in series with resistors.

It is the applicant's contention that the buncher of EP 0456516 will not operate as described. For satisfactory operation of the buncher, it is necessary to be able to collapse the retarding field at the end of the initial part of the time interval in a time that is much shorter than the transit time for ions to traverse the plurality of electrodes. The applicant believes that the described buncher will not be capable of achieving this because the retarding field is maintained by a conduction current flowing between the plurality of electrodes so that the electric field shape is generated by supporting free charges on intermediate electrodes of the plurality of electrodes. When the field is reduced to zero the free charges have to flow away to ground through the resistors. For a given electrode, this takes a time equal to several times RC where R is the resistance to ground and C is the capacitance of the electrode. In practice, R will be determined by the properties of the power supply and C by the properties of the electrode structure. For a 10 kV, 1 mA supply the minimum value of the resistance will be 10 Megohms, whereas the capacitance of the electrode structure will hardly be less than 10 picofarads. This gives a value for RC of ~100 μs which is of the order of the transit time for ions traveling through the buncher. This is too long for the device to operate as described.

It is an object of the present invention to overcome, or at least reduce, the above mentioned problem.

BRIEF SUMMARY OF THE INVENTION

In this regard, the present invention provides a charged particle buncher comprising a series of spaced apart electrodes arranged to generate a shaped electric field, the series comprising a first electrode, a last electrode and one or more intermediate electrodes wherein the shaped electric field is generated substantially without free charges being transferred onto or away from the intermediate electrode or electrodes.

Generating the shaped field substantially without free charges being transferred onto or away from the intermediate electrodes dramatically reduces the time in which the field can be generated, adjusted and collapsed.

Preferably the buncher comprises a series of at least ten, more preferably at least twenty electrodes. The electrodes preferably comprise plates having apertures through which charged particles may pass. The electrodes are preferably spaced apart and it is preferred that they are evenly spaced apart. One or more of the electrodes may comprise a substantially flat, preferably substantially circular plate.

The first and last electrodes are preferably connected to means for transferring charge on to or off the electrode. In one embodiment, the first electrode is connected to a potential source and the last electrode is connected to ground.

The first, intermediate and last electrodes are preferably connected in series alternately with capacitors. The shape of the electric field to be generated is then determined, inter alia, by the capacitance between each pair of adjacent electrodes.

With this arrangement, the shaped electric field is generated principally by Maxwell's displacement field with free charges being transferred on to or away from the first and last electrodes only.

The speed with which the shaped displacement field can be generated and adjusted is then determined by the magnitude of the current flowing to or from the first and last electrodes. Electronic switches using field effect transistors can sustain high switching currents of in excess of 100 Amperes making it possible to apply a potential of several kilovolts in a few nanoseconds, thus greatly reducing the time to adjust the shaped electric field compared to the apparatus of EP 0456516.

Preferably, the magnitude of displacement current flowing onto or away from the intermediate electrodes exceeds any conduction current flowing onto or off the intermediate electrodes by at least four orders of magnitude, more preferably at least five orders of magnitude.

Preferably, the electric field is shaped such that charged particles traveling through the buncher and having the same mass to charge ratio are all brought substantially into time focus in a plane downstream of the buncher.

The capacitors may be connected in parallel with resistors chosen to allow a proportionally small conduction current to flow between the electrodes to allow any free charges to drain from the plates, but without substantially affecting performance of the buncher.

The series of electrodes is preferably preceded by a pulse former and/or followed by a detector.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
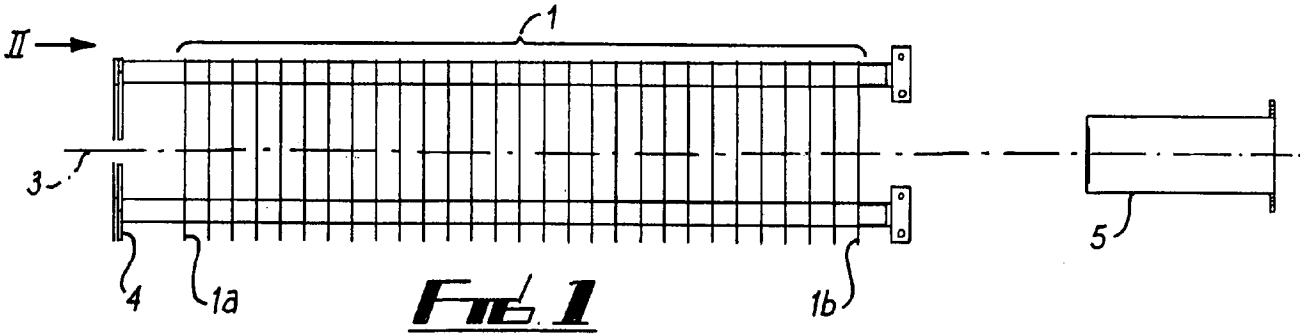
FIG. 1 is a schematic side view of a charged particle buncher according to the invention.
Figure 2:
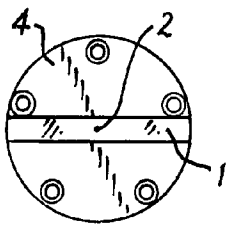
FIG. 2 is an end view of the buncher of FIG. 1 looking in the direction of arrow II.
Figure 3:
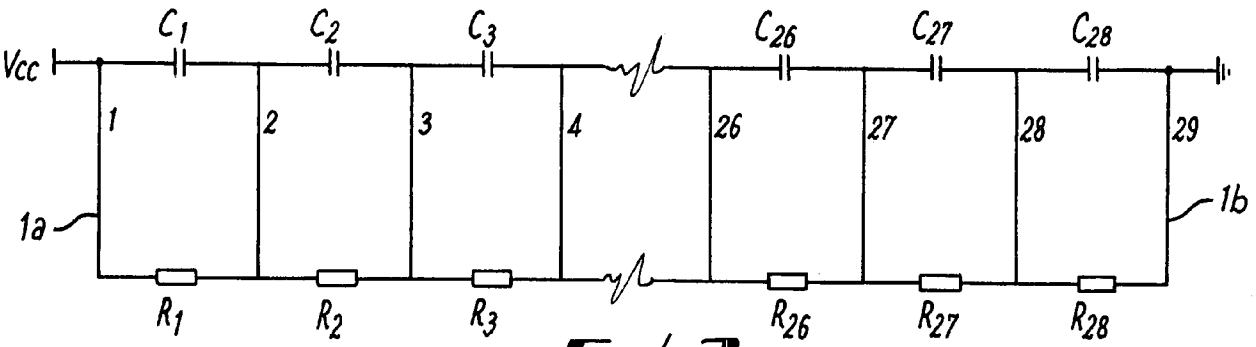
FIG. 3 is a schematic circuit diagram of the buncher of FIG. 1.

Referring to FIGS. 1 to 3 the buncher comprises a series of twenty-nine substantially circular substantially flat plate electrodes 1. The electrodes 1 are substantially parallel and evenly spaced apart. Each electrode has a substantially circular aperture 2 formed through its center and is aligned so that all the apertures 2 of the electrodes 1 lie about an axis 3 of the buncher.

The first electrode (electrode 1) of the series is indicated as 1*a*. Preceding this electrode along the buncher axis 3 is a pulse former 4 comprising two generally semi circular plates mounted in a plane parallel to the electrodes 1 and spaced either side of the buncher axis 3.

The last electrode of series (electrode 29) is indicated as 1*b*. Beyond this electrode along the buncher axis 3 there is disposed a particle detector 5.

Electrode 1 is connected to a voltage source Vcc and electrode 29 is connected to ground. Electrode 1 is connected in series with the intermediate electrodes (electrodes 2 to 29) by means of capacitors $C_{1-28}$ and resistors $R_{1-28}$ in parallel. That is, each plate is connected to the next plate in the series by a capacitor and resistor arranged in parallel with each other.

In use, charged particles traveling along or near the buncher axis 3 enter the series of electrodes 1 at electrode 1*a*, and travel through the electrodes 1 to the detector 5. During transit of the particles electrodes through the series of electrodes, a voltage of about 10 kilovolts is suddenly applied to the first electrode 1*a* and then removed by means of a high voltage switch (not shown). This causes the electrodes 1 to generate a transient shaped electric field which is chosen so as to accelerate charged particles traveling through the buncher such particles with the same mass to charge ratio are brought into time focus at the detector 5.

Connecting the electrodes with capacitors C enables a shaped electric field to be generated without free charges being transferred on to or off the intermediate electrodes. In principle, the buncher would operate without the resistors R. These are included to allow any free charges that accumulate on the electrodes during operation of the device to drain away. It would be feasible to operate the device without the resistor chain but, if free charges from, for example, the charged particle beam were to alight on the electrodes there would be no possibility of their draining away. This would have the property of distorting the shaped field leading to a loss of performance.

The resistor R-values are chosen so that during operation of the device the conduction current flowing between the electrodes 1 is small compared to the displacement current. The resistors R sum to a value of ~100 megohms. When the potential of 10 kilovolts is suddenly applied this gives rise to a conduction current of ~100 microamperes. In contrast, the displacement current is determined only by the current carrying capability of the high voltage switch. A suitable switch is supplied by Behlke Electronic GMBH and has a switching current of 30 Amperes. Thus, the displacement current exceeds the conduction current by five and a half orders of magnitude.

Conduction current and displacement current are defined in Maxwell's fourth equation:

$$\text{Curl } H=j+\partial D/\partial t.$$

This states that the conduction current, j, is equal to the line integral of the magnetic field, H, which circulates around a wire. This circulating magnetic field does not fall to zero between the first and last electrodes of the buncher. It is sustained by the changing displacement field, $\partial D/\partial t$, which generates the electric field between the electrodes of the buncher.

The displacement field, D=,E+P, where E is the electric field which actually accelerates the charged particles and P is the polarization field which is determined by the capacitance between the electrodes. The displacement field is determined only by free charges and these only appear on the first and last electrodes so the displacement field is uniform between the plates. The polarization field increases as we progress towards the last, grounded, electrode because this is proportional to the capacitance. Therefore, the electric field reduces and is therefore shaped.

As the buncher is required to bring charged particles of the same mass to charge ratio to time focus at the detector the required electric field shape and hence values for the capacitors C can be determined from a solution to the following equation:

$$(m/2q)^{1/2}[L/\epsilon^{1/2}+\int dU/(\epsilon-U)^{1/2}dU/dz]=T$$

where dU/dz is the electric field at any point on the z axis of the buncher after the voltage has been applied, $\epsilon$ is the final kinetic energy of the charged particle, L is the drift length from the exit plane of the buncher to the detector, m/q is the charge to mass ratio of the charged particles and T is a constant.

The analytical solution to this equation, which is rather complex, is given in the Appendix I, which follows.

Essentially, the problem can be viewed as an evolution from the harmonic case where the drift region is zero to the general case where a drift region is finite. As the drift region is increased, the shaped field is characterized by a steadily increasing potential step followed by a diminution of the slope of the electric field when compared to the harmonic case. The potential step effectively rejects ions with energy too low where their time in the drift region is longer than the time of flight for ions of that mass to charge ratio.

In practice, the way in which the capacitor C values are determined is as follows. The solution to the above equation has actual values of the various coefficients inserted so that the shape of the field on the buncher 3 can be determined.

This gives a distribution of potentials on the axis, which can be used to determine "starting voltages" for the various electrodes. An ion optical modeling program (see Appendix II) is then used to optimize the voltages on the electrodes to give the lowest temporal spread for a group of ions with pre-determined starting positions and energies within the buncher. The capacitance values are then determined from the inter-electrode voltages using the following expression:

$C1dV1/dt=C2dV2/dt=C3dV3/dt \ldots =dq/dt$ (the displacement current.)

The resistor R values are calculated in a similar way to the capacitance in that: (V29−V28)/R28=(V28−V27)/R27=. . . =(V3−V2)/R2=(V2−V1)/R1=i (the conduction current). Because the displacement current so exceeds the conduction current, the reactance of the capacitors dominates the transient performance of the buncher. Therefore, the resistors could have slightly different values without affecting the overall performance.

In the described embodiment the values of capacitance and resistance and the magnitude of the voltage on each electrode when a voltage of about 9.5 KV is applied to electrode number 1 are as follows:

| Electrode Number | Voltage | Capacitance/ nF | Resistance/ Mohms |
|---|---|---|---|
| 29 | 0 | 1.86 | 3.705 |
| 28 | 344.0 | 30.4 | 0.282 |
| 27 | 375.0 | 4.71 | 1.467 |
| 26 | 596.4 | 5.24 | 1.380 |
| 25 | 694.2 | 4.58 | 1.539 |
| 24 | 920.1 | 4.15 | 1.683 |
| 23 | 1074.7 | 3.80 | 1.848 |
| 22 | 1314.1 | 3.53 | 1.980 |
| 21 | 1518.6 | 3.18 | 2.130 |
| 20 | 1778.0 | 3.04 | 2.265 |
| 19 | 2026.8 | 2.89 | 2.430 |
| 18 | 2311.6 | 2.78 | 2.577 |
| 17 | 2600.1 | 2.64 | 2.718 |
| 16 | 2913.9 | 2.51 | 2.850 |
| 15 | 3239.3 | 2.41 | 3.009 |
| 14 | 3587.3 | 2.32 | 3.153 |
| 13 | 3944.3 | 2.25 | 3.330 |
| 12 | 4322.5 | 2.18 | 3.450 |
| 11 | 4716.2 | 2.11 | 3.600 |
| 10 | 5128.0 | 2.05 | 3.747 |
| 9 | 5555.4 | 2.00 | 3.900 |
| 8 | 6000.5 | 1.95 | 4.080 |
| 7 | 6461.6 | 1.91 | 4.170 |
| 6 | 6939.6 | 1.87 | 4.410 |
| 5 | 7434.5 | 1.83 | 4.500 |
| 4 | 7946.3 | 1.79 | 4.650 |
| 3 | 8475.1 | 1.76 | 4.800 |
| 2 | 9019.9 | 1.73 | 4.920 |
| 1 | 9586.8 | | |

Figure 4:
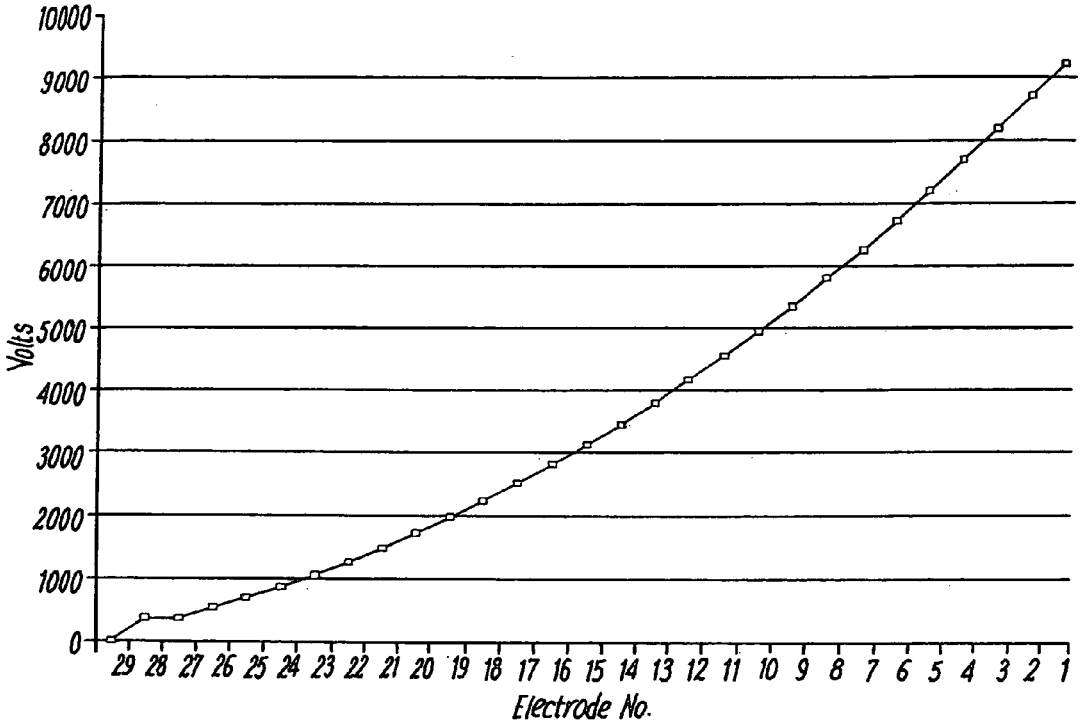
FIG. 4 is a graph of voltage against electrode number for the buncher of FIG. 1.
Figure 6:
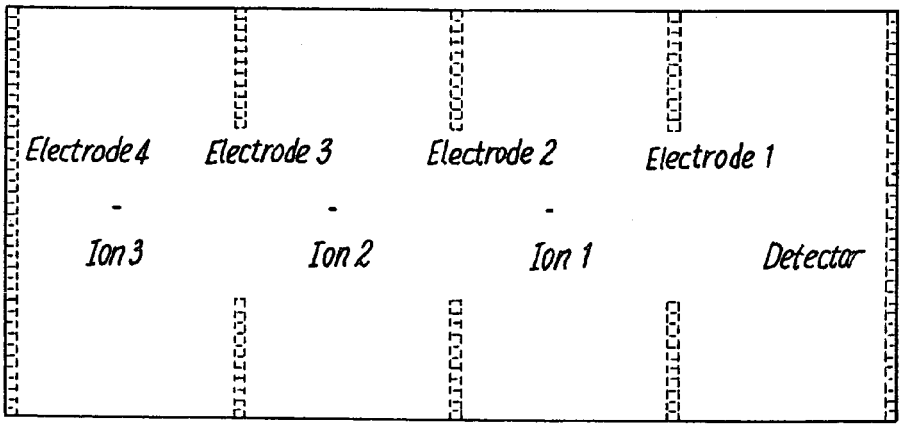
FIG. 6 is a schematic view of the four electrode buncher referred to in Appendix II.

The electrode voltages are also shown in FIG. 4. Note that, in the above table, the resistors and capacitors are between the electrodes. When the voltage is applied to electrode no. 1 the displacement current through the capacitors is so much larger than the conduction current flowing down the resistor chain that the transient voltages on the electrodes are dominated by the reactance of the capacitors.

Operation of the device will now be described in further detail.

Charged particles from a continuous or quasi-continuous ion source are accelerated to a certain potential, preferably 100 eV, and allowed to pass into the space between the two electrodes of the pulse former 4 and then along the axis 3 of the buncher through the series of electrodes 1 towards the detector 5.

When the buncher is filled, i.e. when charged particles are distributed along the buncher axis 3 between the first 1*a* and last 1*b* electrodes, a voltage is applied to the first electrode 1*a* for a period of time to generate a shaped electric field. This field accelerates the charged particles out of the buncher towards the detector 5. Particles closer to the first electrode 1*a* are subjected to greater acceleration than those closer to the last electrode resulting in the particles being brought in time focus at the detector. Typically, particles from greater than 70% of length of the buncher can be brought into time focus at the detector.

The bunched charged particles generate an electrical signal when they impinge upon the detector. This signal may be taken in its entirety to a fast transient digitiser and a digital copy can be made. Alternatively, the signal can be passed through a discriminating amplifier and the resulting pulses taken to a time to digital converter. Either of the above methods will result in the production of a spectrum of intensity versus time. It is then straightforward to assign a mass scale to the spectrum.

The pulse former 4 is preferably used to sweep the charged particles into the buncher through the aperture in the first electrode 1*a* when the buncher ready to be filled and to sweep the charged particles out of the aperture when the buncher is filled. This makes possible differing filling factors for the buncher which, with an adjustable buncher firing pulse delay, can utilize different regions of the shaped field in order to optimize the resolution.

Figure 5:
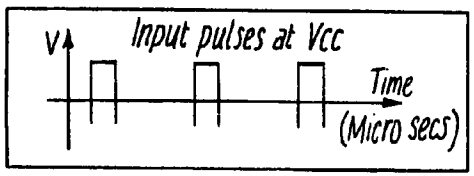
FIG. 5 is a graph of voltage against time applied to the first electrode.

A typical signal applied to the first plate 1*a* of the buncher is shown in FIG. 5.

Figure 7:
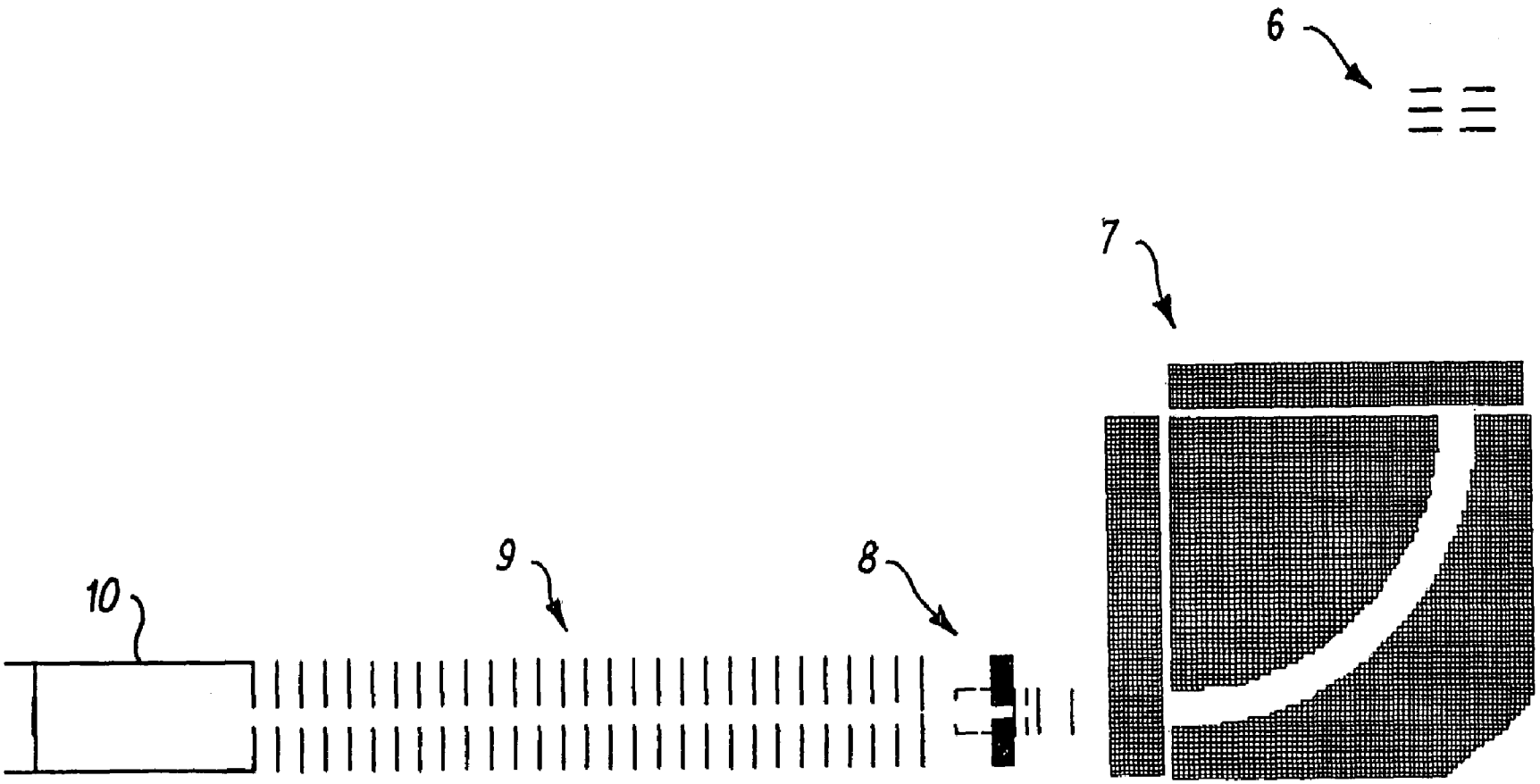
FIG. 7 is a schematic view of the buncher of FIG. 1 incorporated into a mass spectrometer.

The charged particle buncher may form part of a mass spectrometer when used in conjunction with a source of ions. The charged particle buncher does not exhibit a wide energy bandwidth. In fact, small energy differences from the nominal energy will significantly degrade the resolution available from the mass spectrometer. For this reason it is desirable to pass the ion beam from the ion source through an electrostatic analyzer before it enters the pulse former. Referring to FIG. 7, charged particles from an ion source 6 are emitted continuously to form a beam, which passes into an electrostatic analyzer 7. This device selects the ions according to their kinetic energy and focuses them into the pulse former 8. The pulse former admits ions into the buncher 9 for a period of time that is typically 50 microseconds. When the buncher fires the potential distribution is suddenly applied such that all charged particles of a given mass to charge ratio spatially distributed along the axis are accelerated and brought into time focus at a detector 10. When the ion source releases ions, which are monochromatic in nature, there is an advantage to filtering their kinetic energy before admitting the ions into the buncher. Only ions generated in the ion source will be transmitted successfully through the electrostatic analyzer 9; scattered ions and ions generated by collisions in the beam line will not have the correct energy to pass through the energy analyzer and will therefore be rejected. This process helps to remove background signals from the mass spectrometer and therefore improves the limit of detection and dynamic range of the device.

The above embodiment is described by way of example only. Many variations are possible without departing from the invention.

Appendix I

The theoretical consideration of an ideal buncher produces the following problem.

An ion of mass m, charge q and initial energy $q\epsilon_0$ appears in the cell of the buncher at position x and gains energy of $q\epsilon$ from the potential U(x). The ion is accelerated through the cell and flies through a field free region of length L. For an ideal buncher the time of flight, T must be independent of the initial position x and hence the energy $q\epsilon$ gained from the potential (for the energy range $q\epsilon_1$ to $q\epsilon_2$).

This gives the equation $$\left(\frac{m}{2q}\right)^{1/2}\left[\frac{L}{(\varepsilon+\varepsilon_0)^{1/2}}+\int_0^{\varepsilon}\frac{dU}{(\varepsilon+\varepsilon_0-U)^{1/2}\frac{dU}{dx}}\right]=T=\text{constant}$$

A general solution in terms of the inverse function x(U) is given in Ref 1 for the case $\epsilon_0=0$ by multiplying both sides by $d\epsilon/\lfloor(V-\epsilon)^{1/2}\rfloor$ and integrating for $\epsilon$ from $\epsilon_1$ to $\epsilon_2$.

$$\pi\cdot x(U)=k\cdot L\cdot\left(\frac{U-\varepsilon_1}{\varepsilon_1}\right)^{1/2}-L\cdot\arctan\left(\frac{U-\varepsilon_1}{\varepsilon_1}\right)^{1/2}-\int_0^{\varepsilon_1}\frac{dx}{dV}\cdot\arctan\left(\frac{U-\varepsilon_1}{\varepsilon_1-V}\right)^{1/2}dV$$

The integral on the right hand side means that the potential distribution is arbitrary while $U<\epsilon_1$. The simplest solution for this is a potential step (a small gap with a constant field), which would give the general solution with a gap thickness d.

$$\pi\cdot x(U)=(k\cdot L-d)\cdot\left(\frac{U-\varepsilon_1}{\varepsilon_1}\right)^{1/2}+\pi\cdot d\cdot\left(\frac{U-\varepsilon_1}{\varepsilon_1}\right)-\left(L+\frac{d\cdot U}{\varepsilon_1}\right)\cdot\arctan\left(\frac{U-\varepsilon_1}{\varepsilon_1}\right)^{1/2}$$

The constant k represents the ratio of the time of flight of an ion of energy $q\epsilon_1$ in the drift region to that of the time of flight in the drift region and step region thus for the step case $k\geqq(L+2d)/L$.

Appendix II

Auto-Tuning ToF Program for Simion

This program uses an auto-tuning algorithm for adjusting the electrode voltages to give a time focus for ions of the same mass within these electrodes at the detector. The program is a user program in the Simion 3D Ion Modeling Software (see SIMION 3D Version 6.0 by David A. Dahl 43ed ASMS conference on Mass Spectrometry and Allied Topics, May 21–26 1995, Atlanta, Ga., pg 717).

This simplified program uses a four-electrode device and measures the time of flight for three ions between these electrodes to the detector as shown in FIG. 5. A copy of the program is shown below.

Initial values for the electrodes are set and initial ion run commences. The ToF (Time of Flight) of the first ion is recorded and set as Total_TOF, which is the required ToF for all the ions. The later ions are compared to this Total_TOF and if these differences are greater than the required accuracy then the voltage of the electrode preceding the ion is increased by the ration of the ToF difference to the Total_TOF.

The program is rerun until all ToF's are within the required accuracy. A final run gives a print out of the entire ion ToF's and the final values of the electrode potentials.

```
;-------------- Program for Auto Tuning ToF Measurement ------------
;
defa Total_Ions                 3          ; Total number of ions
defa Ions_OK                    0          ; Number of Ions within delta T
defa Goal_For_Delta_T           0.001      ; Required value of delta T
defa Total_TOF                  1.5        ; Initial Total ToF
defa Adjust_Voltage             1.0        ; Voltage adjust ratio
defa Electrode_Potential_1      0.0        ; initial voltage allowed for tuning
defa Electrode_Potential_2      1000       ; initial voltage allowed for tuning
defa Electrode_Potential_3      2000       ; initial voltage allowed for tuning
defa Electrode_Potential_4      3000       ; initial voltage allowed for tuning
defa Final_Run                  0          ; set for final run
defs Update_PE                  1          ; set update pe flag for each run
;
;-------------------- Set Fast Adjust Electrode Voltages --------------
;
Seg Fast_Adjust
    rcl Electrode_Potential_1              ; set electrode 1
    sto Adj_Elect01
    rcl Electrode_Potential_2              ; set electrode 2
    sto Adj_Elect02
    rcl Electrode_Potential_3              ; set electrode 3
    sto Adj_Elect03
    rcl Electrode Potential_4              ; set electrode 4
    sto Adj_Elect04
;
; -------------------- Update PE Surface Display ------------
;
Seg Other_Actions
    rcl Update_Pe                          ; get pe update flag
    X=0 exit                               ; exit if already updated
    0 sto Update_PE                        ; reset pe update flag
    1 sto Update_PE_Surface                ; update the pe surface
;
; -------------------- Tuning Control Module ------------------
;
Seg Terminate
    rcl Final_Run
    1 X=Y goto Print                       ; If final run send to print statement
    rcl Ion_Number
    1 X!=Y goto Difference                 ; If not ion 1 send to ToF Difference
    rcl Ion_Time_Of_Flight
    sto Total_TOF                          ; Store ion 1's ToF as Total ToF
    0 sto Ions_OK                          ; Reset counter for ions within delta T
    exit
  lbl Print
    rcl Ion Time_Of_Flight                 ; Print statement to give ToF of all
    rcl Ion_Number                         ; ions and the final potentials
    mess ; Ion Number = #, ToF = #,
    rcl Ion_Number
    rcl Total_Ions
    X!=Y exit
    rcl Electrode_Potential_2
    rcl Electrode_Potential_1
    mess ; Potential 1 = #, Potential 2 = #
    rcl Electrode_Potential_4
    rcl Electrode_Potential_3
    mess ; Potential 3 = #, Potential 4 = #
    0 sto Rerun_Flym                       ; flag termination
    exit
  lbl Difference
    rcl Ion_Time_Of_Flight                 ; If difference between measured ToF
    rcl Total_TOF -                        ; and actual ToF is greater than the
    abs                                    ; allowed ToF difference then send
    rcl Goal_For_Delta_T                   ; to recalculate potentials
    X<Y goto Recalculate
    rcl Ion_Number
    rcl Ions_OK
    1 +
    sto Ions_OK
    rcl Total_Ions
    1 -
    X!=Y exit
    rcl Total_Ions
    rcl Ion_Number
    X!=Y exit                              ; If all the ion are within the
    1 sto Final_Run                        ; allowed ToF difference then send
    1 sto Rerun_Flym                       ; for final run
    exit
```

-continued

```
lbl Recalculate
  rcl Ion_Time_Of_Flight
  rcl Total_TOF -                ; Evaluates the ratio of the ToF
  rcl Total_TOF /                ; difference to the total ToF and
                                 ; then calculates the required change
  1 +                            ; to the potentials
  sto Adjust_Voltage
  rcl Ion_Number
  2 X=Y goto Second
  rcl Ion_Number
  3 X=Y goto Third
lbl Second
  rcl Electrode_Potential_2
  rcl Electrode_Potential_3      ; Adjust Electrode Potential for
  rcl Adjust_Voltage *           ; next run if greater than previous
  X<Y exit                       ; electrode
  sto Electrode_Potential_3
  1 sto Rerun_Flym
  exit
lbl Third
  rcl Electrode_Potential_3
  rcl Electrode_Potential_4      ; Adjust Electrode Potential for
  rcl Adjust_Voltage *           ; next run if greater than previous
  X<Y exit                       ; electrode
  sto Electrode_Potential_4
  1 sto Rerun_Flym
  exit
```

What is claimed:

1. A charged particle buncher comprising:

a series of spaced apart electrodes arranged to generate a shaped electric field, the series comprising a first electrode, a last electrode and one or more intermediate electrodes, wherein the shaped electric field is generated substantially without free charges being transferred onto or away from the intermediate electrode or electrodes, such that in use, the magnitude of displacement current flowing onto or away from the intermediate electrodes exceeds any conduction current flowing onto or off the intermediate electrodes by at least four orders of magnitude, said electrodes operating to apply said shaped electric field in a manner that causes temporal alignment of charged particles traveling therebetween such that the space between said charged particles approaches zero.

2. A charged particle buncher according to claim 1, further comprising:

a series of at least ten electrodes.

3. A charged particle buncher according to claim 1, wherein said electrodes comprise plates having apertures through which charged particles may pass.

4. A charged particle buncher according to claim 1, wherein said electrodes are substantially flat.

5. A charged particle buncher according to claim 1, wherein the first and last electrodes are connected to means for transferring charge on to or off the electrode.

6. A charged particle buncher according to claim 1, wherein the first, intermediate and last electrodes are connected in series with capacitors.

7. A charged particle buncher according to claim 1, the electric field is shaped such that charged particles traveling through the buncher and having the same mass to charge ratio are all brought substantially into time focus in a plane downstream of the buncher.

8. A charged particle buncher according to claim 1, wherein the series of electrodes is preceded by a pulse former and/or followed by a detector.

9. A charged particle buncher according to claim 1, wherein the electrodes are connected in series with resistors.

* * * * *